US012696976B1

(12) United States Patent
Kuriakose et al.

(10) Patent No.: US 12,696,976 B1
(45) Date of Patent: Aug. 4, 2026

(54) HIGH DENSITY CONTAINER SUPPORT STRUCTURE FOR USE WITH ROBOTIC SYSTEMS

(71) Applicant: Amazon Technologies, Inc., Seattle, WA (US)

(72) Inventors: Annu Kuriakose, Waltham, MA (US); Jeremy Heaston, Ashland, MA (US); Grant Elliott Garbach, Cambridge, MA (US)

(73) Assignee: Amazon Techologies, Inc., Seattle, WA (US)

( * ) Notice: Subject to any disclaimer, the term of this patent is extended or adjusted under 35 U.S.C. 154(b) by 55 days.

(21) Appl. No.: 18/756,868

(22) Filed: Jun. 27, 2024

(51) Int. Cl.

| | |
|---|---|
| ***A47B 47/02*** | (2006.01) |
| ***A47B 47/00*** | (2006.01) |
| ***A47B 96/02*** | (2006.01) |
| *A47B 87/02* | (2006.01) |

(52) U.S. Cl.
CPC ..... *A47B 47/021* (2013.01); *A47B 47/0083* (2013.01); *A47B 96/021* (2013.01); *A47B 87/0207* (2013.01)

(58) Field of Classification Search
CPC . A47B 47/021; A47B 47/0083; A47B 96/021; A47B 47/00; A47B 47/024; A47B 57/06; A47B 57/30; A47B 87/00; A47B 87/02; A47B 87/0207
See application file for complete search history.

(56) References Cited

U.S. PATENT DOCUMENTS 1,430,748 A * 10/1922 Nolte ..... A47J 47/16 211/78
2,604,214 A * 7/1952 Fussell ..... A47G 25/0664 211/196
3,543,943 A * 12/1970 Joy ..... A47F 5/05 211/163
4,066,172 A * 1/1978 Howard ..... B62B 3/104 248/146
4,193,351 A * 3/1980 Belokin, Jr. ..... A47F 5/04 108/106
4,444,322 A * 4/1984 Lee ..... A47F 5/13 211/175

(Continued)

*Primary Examiner* — Devin K Barnett
(74) *Attorney, Agent, or Firm* — Eversheds Sutherland (US) LLP

(57) ABSTRACT

Systems and methods are disclosed for a container support system which may include a container support structure and/or containers that may be positioned into and retrieved from the container support structure. Container support structures may include a base supporting a central post that may support shelf assemblies offset from one another along the central post. Each shelf assembly may include several shelf portions that together with other shelf portions form container receiving areas for receiving containers. The support structure may include multiple sides with openings to container receiving areas on each side of the support structure. Robotic pickers may approach a side of the container support structure and receive a container from one of the openings of that side of the container support structure. With openings on each side of the container support structure, robotic pickers may easily and efficiently retrieve containers from the container support structure.

14 Claims, 8 Drawing Sheets

(56) References Cited

U.S. PATENT DOCUMENTS

| | | | | |
|---|---|---|---|---|
| 5,255,801 | A * | 10/1993 | Berger | A47F 5/05 211/163 |
| 11,713,160 | B1 * | 8/2023 | Simons | B65D 19/0012 206/386 |
| 12,342,932 | B1 * | 7/2025 | Heaston | B65G 1/02 |
| 2012/0305037 | A1 * | 12/2012 | Petric | A61B 90/70 134/198 |
| 2013/0105426 | A1 * | 5/2013 | Dyck | A47B 57/485 211/184 |
| 2014/0265803 | A1 * | 9/2014 | Kelly | F25D 25/024 312/404 |
| 2016/0236306 | A1 * | 8/2016 | Winnicka | A47B 87/0223 |
| 2017/0065078 | A1 * | 3/2017 | Sabounjian | A47B 57/265 |
| 2018/0084928 | A1 * | 3/2018 | Winikoff | G09F 7/18 |
| 2023/0122809 | A1 * | 4/2023 | McMillin | F25D 25/02 312/223.5 |
| 2023/0271777 | A1 * | 8/2023 | Ambrosi | B65G 1/0407 414/267 |
| 2025/0160542 | A1 * | 5/2025 | Au | A47F 5/103 |
| 2025/0318639 | A1 * | 10/2025 | Wu | A47B 57/20 |

* cited by examiner

HIGH DENSITY CONTAINER SUPPORT STRUCTURE FOR USE WITH ROBOTIC SYSTEMS

BACKGROUND

As users increasingly make online purchases, fulfilment of such purchases and other orders may become increasingly complicated. For example, a fulfillment center may have output of upwards of one million packages per day. With such demands, efficiency of logistics related to processing orders and packages may be important. Accordingly, improvements in various operations of order fulfillment, such as improvements to picking technology, sorting technology, packing technology, and so forth may be desired, such that throughput can be increased and sustainability can be improved.

Figure 1:
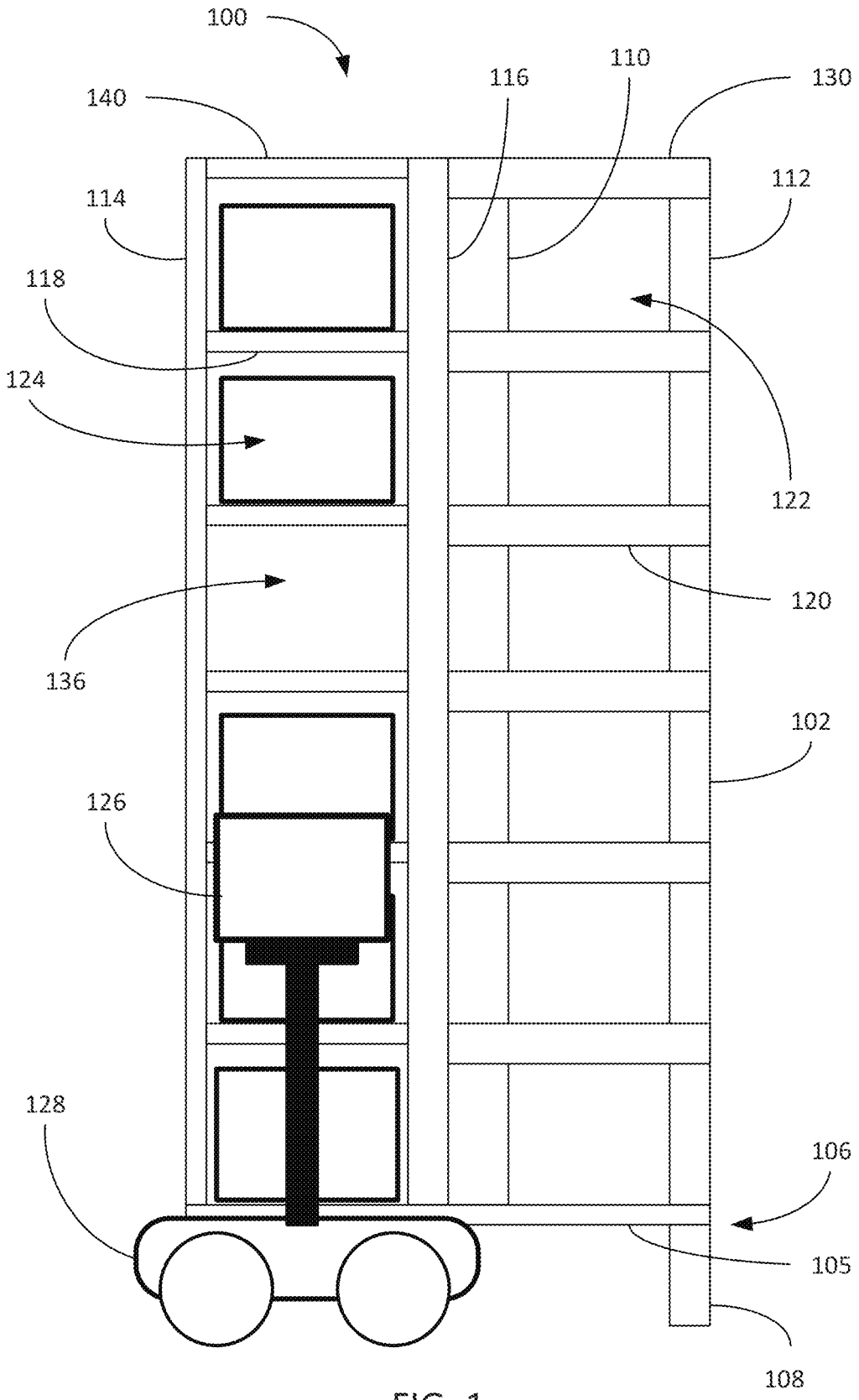
FIG. 1 is a schematic illustration of an example use case for a high density container support system for use with robotic picking systems, in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar, but not necessarily the same or identical components. Different reference numerals may be used to identify similar components. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

Fulfillment centers may be used to fulfill online purchases and other orders. For example, fulfillment centers may include product inventory that may be pulled when an order for a particular product or multiple products is placed. As items are placed into containers (e.g., totes, bins, bags, etc.) for storage, transport, sortation, etc., the containers may be placed in pods or other structures configured to hold a plurality of containers. For example, a container support structure (e.g., a container pod) may be configured to store one or more containers, such as totes, bags, and other suitable containers, in one or more columns and/or rows.

The support structure may be a vertical structure with container receiving areas stacked on top of one another. To facilitate efficient picking, placement, sorting, and the like at fulfillment centers picking robots may place containers into and receive containers from the support structure. Container support structures may include multiple sides with openings to container receiving areas on each side of the support structure such that robotic picking structures may access the container support structures from each side.

Container support structures may include a base supporting a center post. The center post may then be connected to shelf assemblies offset from one another by set distances along the length of the center post. Each shelf assembly may include several shelf portions, that together with other shelf portions forming container receiving areas from receiving containers. The support structure may include multiple sides with openings to container receiving areas on each side of the support structure. Other components such as vertical supports and/or guides may be included in the support structure to provide support and/or form the container receiving areas.

Referring to FIG. 1, an example use case for a high density container support system for use with automated robotic picking systems, in accordance with one or more embodiments of the disclosure is illustrated. Other embodiments may be directed to any suitable use case where products are picked and sorted, or packages are sorted, such as instances where users may pick and/or sort containers rather than an automated robotic picking system.

As shown in FIG. 1, a fulfillment center may include container support system 100, which may support and/or house multiple containers (e.g., totes, bins, bags, etc.), which may be filled with one or more packages, items, bags, products, and the like. The fulfillment center may further include robotic picker 128 which may a robotic and/or autonomous device which may navigate the fulfillment center and may place containers 124 into container receiving areas of container support structure 102 and/or may retrieve containers from container support structure 102. Robotic picker 128 may wheels for traversing the fulfillment center and/or may have an adjustable height picker for reaching a desired container and may move containers for sorting, distribution, and/or order fulfillment purposes.

Container support system 100 may include container support structure 102, containers 124, and/or robotic pickers 128. Container support structure may be a vertical structure designed to receive and support multiple containers on stacked shelf assemblies. For example, shelf assembly 118 may include one or more shelf portions upon which containers are positioned upon and supported. Container support structure may be supported by base 106. Base 106 may include platform 105 that is supported by legs 108. Legs 108 may position the platform a set distance above the floor supporting legs 108. The distance may be selected to permit robotic pickers and/or other autonomous vehicles to move underneath container support structure 102.

Central post 110 may extend vertically and orthogonally from base. For example, central post 110 may be perpendicular with respect to a plane in which platform 105 extends. In one example, platform 105 may be the same structure as shelf assembly 118. Central post 110 may include retaining features (e.g., voids and/or protrusions) upon which shelf assemblies may be connected or otherwise affixed to. In this manner, central post 110 may support the weight or a portion thereof of the shelf assemblies. Vertical supports (e.g., vertical supports 114, 116, and 112) may also be included in container support structure 102 and may similarly be connected to base 106 and/or extend orthogonally from base 106.

Guides (e.g., guide 120) may be connected to shelf portions of each shelf assembly and may extend above and/or below each shelf portion to define a space within which a container may be received along the shelf portion. Guides may be struts, protrusions, bars, or the like that extend from the shelf assemblies and/or other portions of the container support structure for preventing a container from moving beyond a certain area. In one example, the vertical supports may perform the function of guides and guides may not be included.

Container receiving areas (e.g., container receiving areas 122 and 136) may be defined by any combination of shelf assemblies, guides, and/or vertical supports. Container receiving areas may be larger than the respective containers meant to be received by such container receiving areas, such that robotic picker 128 may freely move containers into and out of such container receiving areas.

Container support structure 102 may include additional supports such as upper supports (e.g., upper supports 140 and 130) which may secure vertical supports to one another and/or may serve as guides. Other support components may optionally be included such as "X" bracing between vertical supports and other suitable supportive hardware for improving the strength and/or rigidity of the container support structure.

In another example, robotic picker 128 may be static in that robotic picker 128 may not have wheels but instead may remain in one location with only a picking assembly that moves up and down and optionally in other directions to retrieve containers. In this example, a lift system may be positioned beneath container support structure 102 and may lift container support structure 102 and move container support structure from a first location to a location in front of the static robotic picker to permit the robotic picker to access the containers of container support structure 102.

Illustrative Embodiments and Use Cases

Figure 2:
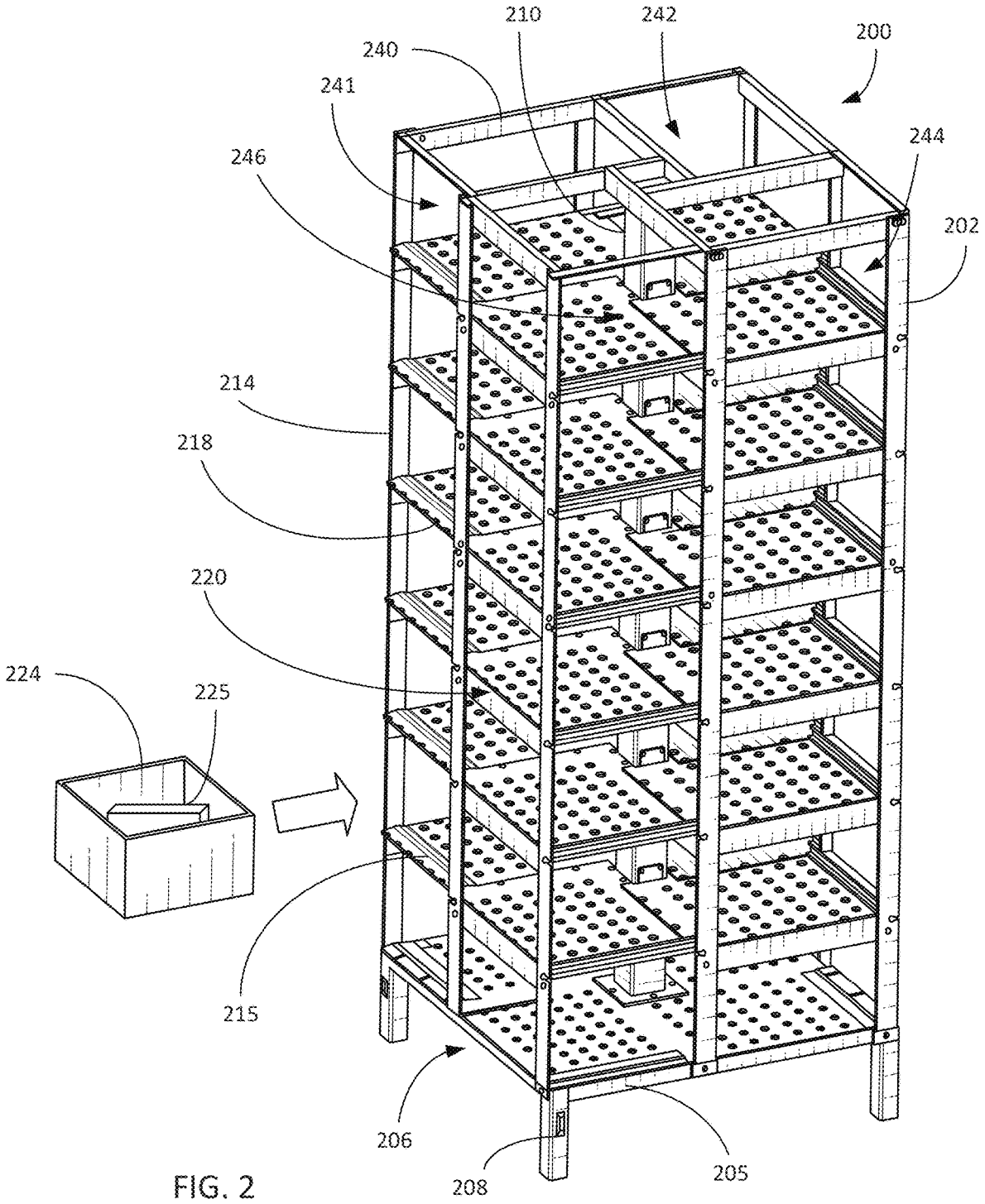
FIG. 2 is a perspective illustration of an exemplary high density container support system with containers, in accordance with one or more embodiments of the disclosure.

Referring now to FIG. 2, is a perspective illustration of an exemplary high density container support system with containers is illustrated, in accordance with one or more embodiments of the disclosure. Container support system 200 may include container support structure 202 as well as containers (e.g., container 224) which may be a container, bin, tote, or the like that is sized to fit within a container receiving area of container support system 200 and to hold one or more items (e.g., item 225), which may be a package, product, item, bag, or the like.

Container support structure 202 may be the same as or similar to container support structure 102 and may contain base 206 having platform 205 and legs 208. Center support 210 may be secured to a mid-region of platform 205 of base 206 and may be positioned orthogonally with respect to base 206. Central support 210 may support shelf assemblies (e.g., shelf assembly 218) which may include one or more shelf portions.

Container support structure 202 may include vertical supports 214 which may further support shelf assemblies and provide rigidity to container support structure 202. Vertical supports may further provide visual guides for sensors of a robotic picking system to determine the location of the container receiving areas. Container support structure may further include guides 220 for restricting movement of containers within a container receiving area and otherwise defining, at least partially, the container receiving area. The container receiving area may further include upper supports 240 for connecting vertical supports to one another, providing guides for restricting movement of containers and/or providing rigidity to container support structure 202. Container receiving area may further include retention protrusion 215 which may be a bump or other obstruction which may resist movement of the container out of the opening of the container receiving area.

Platform 205 may have multiple sides. For example, platform 205 may be rectangular (e.g., square) in shape and may have four sides. Similarly, container support structure 202 may be a cuboid. Four faces of container support structure 202 may have openings for inserting containers into container receiving areas of the container support structure. For example, opening 241 may be positioned on a first side of container support structure 202, opening 242 may be positioned on a second side container support structure 202 and directed 90 degrees from opening 241, opening 244 may be positioned on a third side of container support structure 202 and may directed 180 degrees from opening 241, and opening 246 may be positioned on a fourth side of container support structure 202 and may be directed 270 degrees from opening 241.

Figure 3:
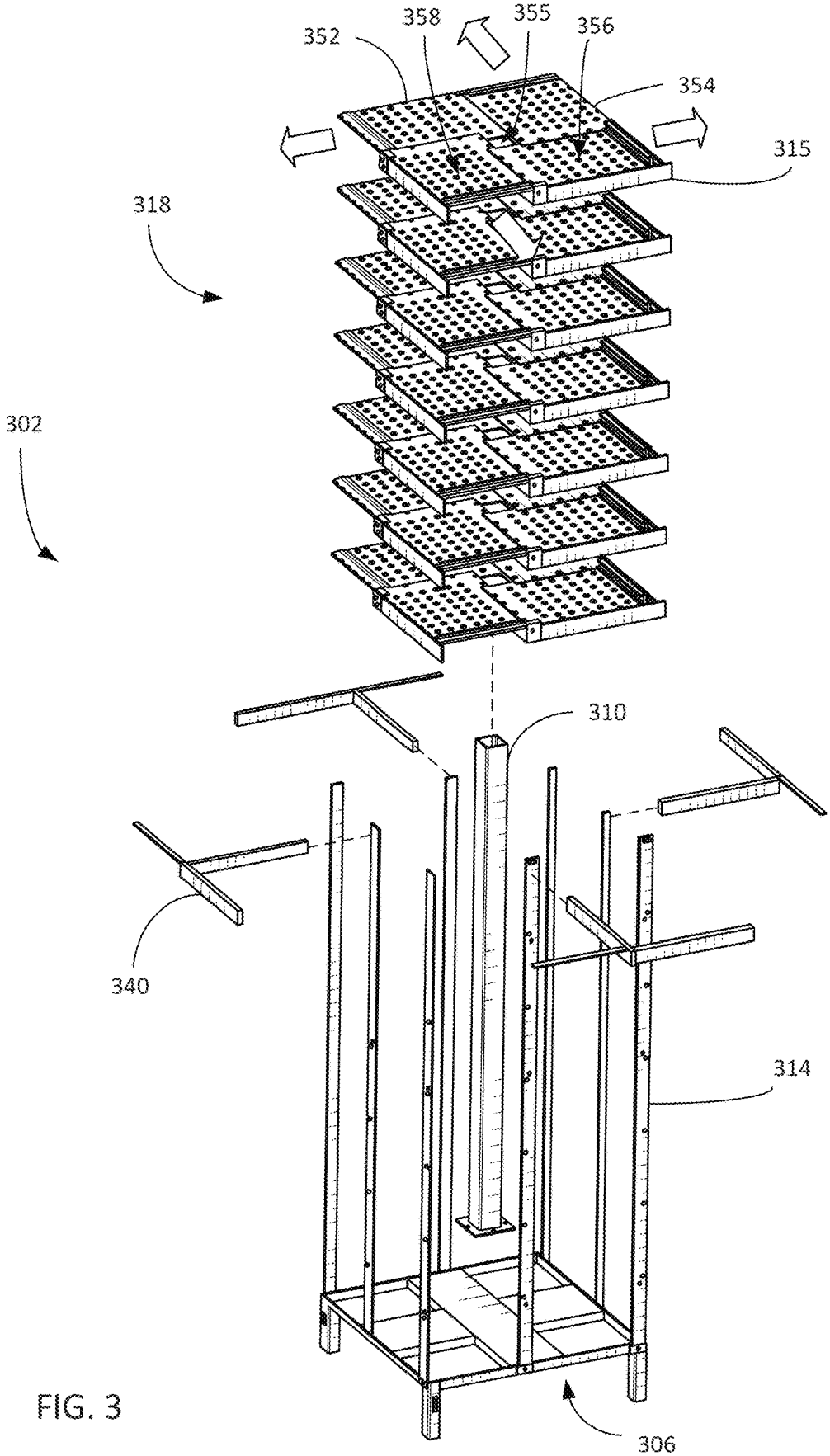
FIG. 3 is an exploded illustration of an exemplary high density container support system, in accordance with one or more embodiments of the disclosure.

Referring now to FIG. 3, an exploded illustration of an exemplary high density container support system is illustrated, in accordance with one or more embodiments of the disclosure. As shown in FIG. 3, container support system 302 may include shelf assemblies 318, base 306, vertical supports 314, central support 310, and optionally upper supports 340. While upper supports 340 are shown in FIG. 3 as four separate pieces it is understood that upper supports 340 may be one piece that may be positioned over the shelf assemblies and/or may interface with center post 310 (e.g., may slide onto centeral post 310). Container support system 302 may be the same as or similar to container support 202 of FIG. 2.

As shown FIG. 3, shelf assembly 315 of shelf assemblies 318 may include multiple shelf portions that may be connected to one another or may be formed from the same continuous shelf forming shelf assembly 315. For example, shelf assembly 315 may include shelf portion 352, shelf portion 354, shelf portion 356 and shelf portion 358. Each of shelf portion may be orientated in a different direction. For example, shelf portion 354 may be rotated 90 degrees from the direction in which shelf portion 352 is facing, shelf portion 356 may be rotated 180 degrees from the direction in which shelf portion 352 is facing, and shelf portion 358 may be rotated 270 degrees from a direction in which shelf portion 352 is facing.

Figure 4:
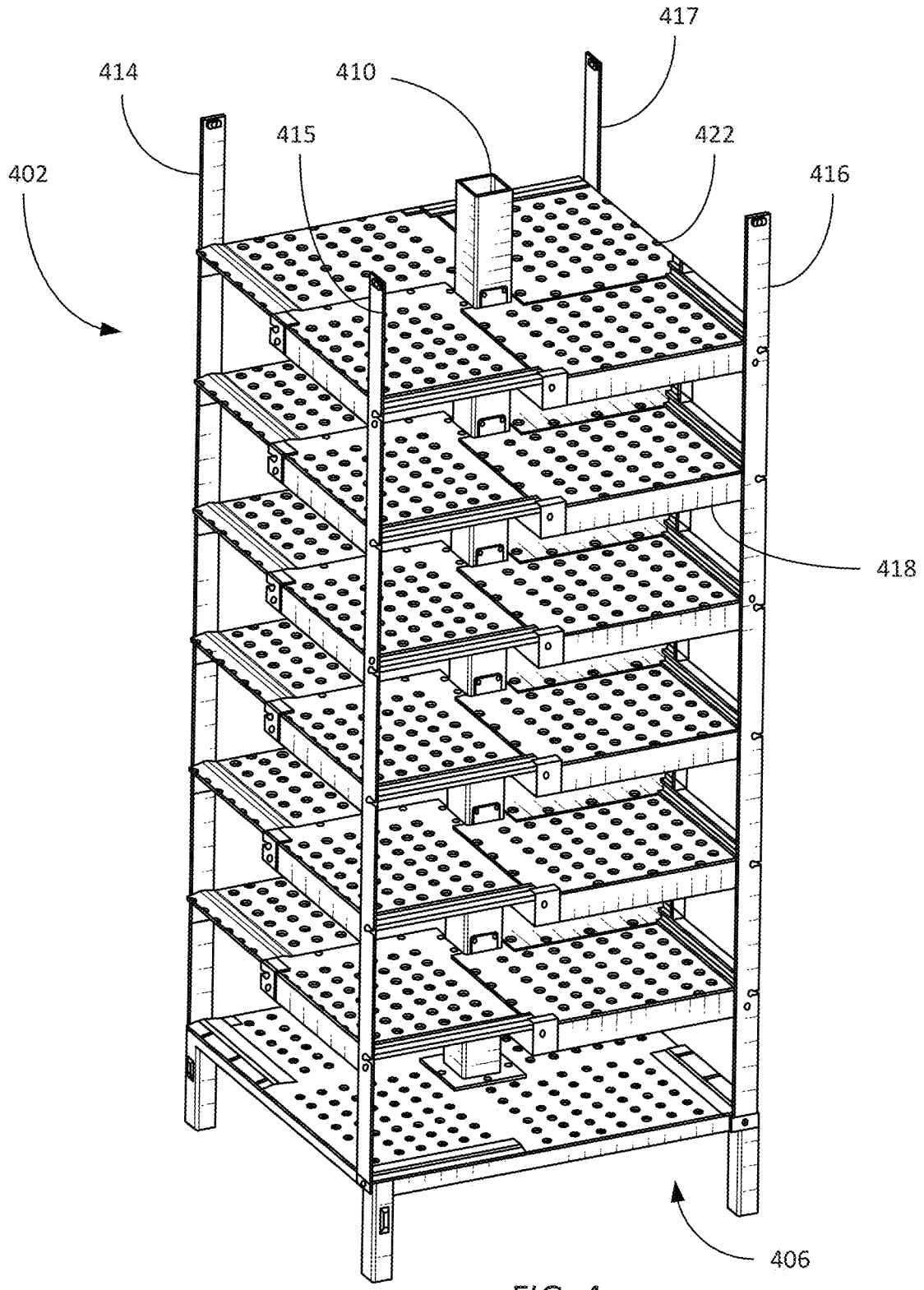
FIG. 4 is a perspective illustration of yet another exemplary high density support system, in accordance with one or more embodiments of the disclosure.

Each shelf assembly may be offset from such other shelf portion along the same plane such that void 355 is formed between each shelf portion. For example, void 355 may be rectangular (e.g., square) in shape and/or may be sized such that central post 310 may be positioned within void 355. In another example, each shelf portion may be on a different plane and may be angled to bias a container to maintain its position within the respective container receiving area. Shelf assembly 315 may be secured to central post via a threaded connection, a protrusion on central post 310 and/or shelf assembly 315, welding, and/or any other suitable connection technology. For example, as shown in FIG. 4, shelf assembly 315 may be riveted to central post 310. Each shelf assembly may be positioned a set distance apart from such other shelf assembly along central post to accommodate and receive a container therebetween. For example, shelf receiving areas may be defined between a shelf portion of an upper shelf assembly, a shelf portion of a lower assembly, guides extending from an upper and/or lower assembly, and/or one or more upper supports.

Shelf portions 352, 354, 356, and 358 may be made of metal and/or may be corrugated, perforated, or otherwise include a number of through holes and/or voids. In another example, shelf portions 252, 254, 256, and 258 may be made from any combination of metal, plastic, and/or fabric, or any other suitable material.

While seven shelf assemblies are illustrated in FIG. 3, it is understood that a greater number of or fewer number of shelf assemblies may be included in container support structure 302. Further a different number of vertical supports and/or upper supports may be included in container support structure. In one example, no vertical supports may be included in the container support structure. In another example, no upper supports may be included in the container support structure.

Referring now to FIG. 4, a perspective illustration of yet another exemplary high density container support system is illustrated, in accordance with one or more embodiments of the disclosure. Container support structure 402 may be similar to container support structure 202 of FIG. 2 and may include base 406, vertical supports 414, 415, 416, and 417, central post 410 and shelf assemblies 418.

Container support structure may 402 differ from container support structure 202 of FIG. 2 in that container support structure 402 may have fewer components. For example, container support structure 402 may not include upper supports and thus may be easier and/or cheaper to manufacture. While vertical supports 414-417 may extend beyond shelf assembly 422 such that containers may be placed upon shelf 422, in another example, vertical supports and center post 410 may terminate at shelf assembly 422.

Figure 5:
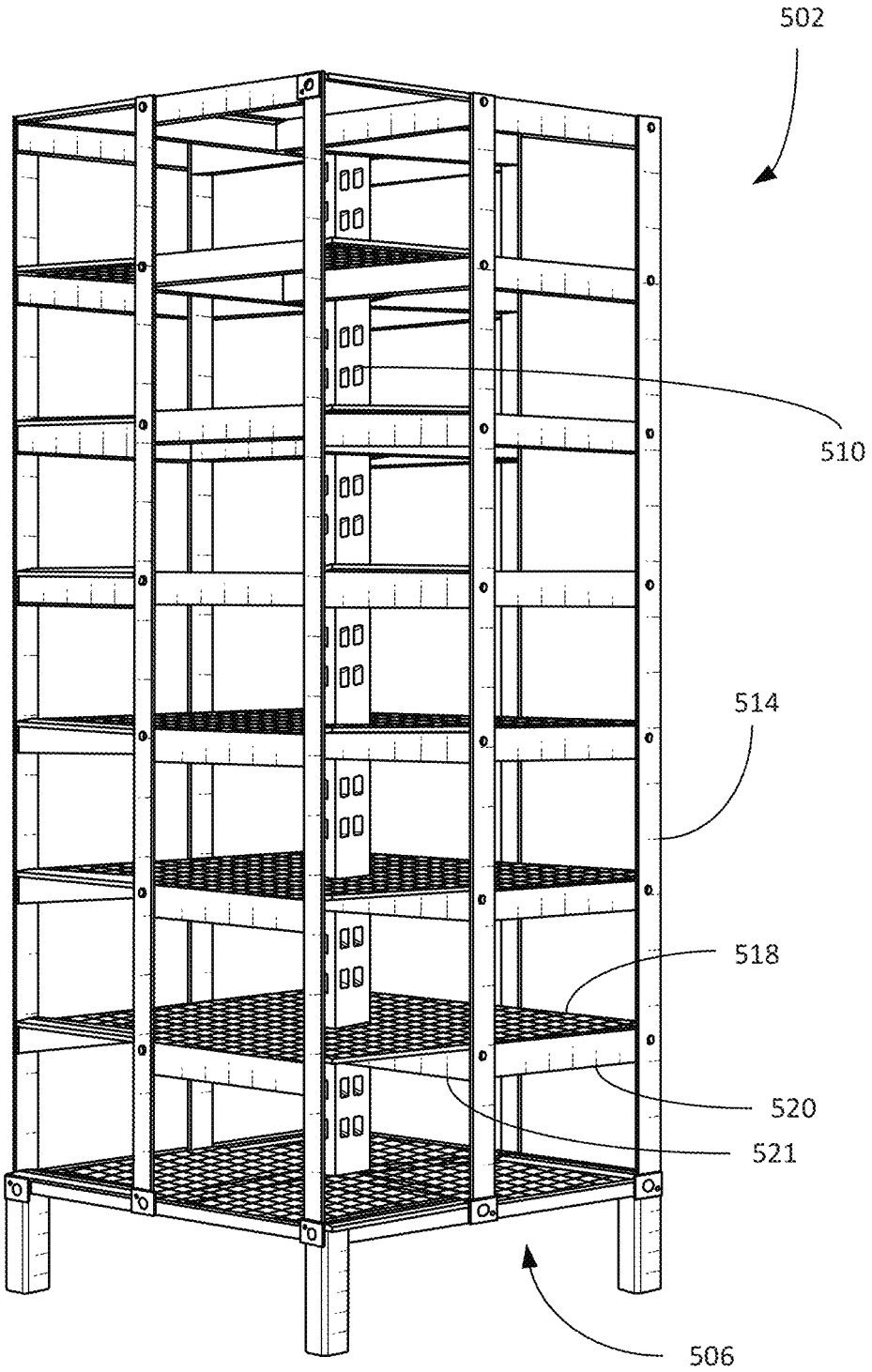
FIG. 5 is a perspective illustration of an exemplary high density support system with mesh wire shelve portions, in accordance with one or more embodiments of the disclosure.

Referring now to FIG. 5, a perspective illustration of an exemplary high density support system with mesh wire shelves is illustrated, in accordance with one or more embodiments of the disclosure. As shown in FIG. 5, container support structure 502 may be similar to container support structure 202 and may include base 506 which may be connected to central post 510 and vertical supports 514, which may support shelf assemblies for receiving containers. Center support 510 may include, for example, voids along the length of central support 510 for receiving a corresponding protrusion of a shelf assembly for securing the shelf assembly to central post 510 or vice versa. Alternatively, or additionally, the holes may be intended to reduce the weight of central post 510. Guides 521 may extend below shelf assemblies and may restrict movement from side-to-side in the container receiving areas and/or prevent containers from moving into different container receiving areas.

Shelf portions of each shelf assembly may be distinct pieces or may be one continue piece. For example, shelf assembly 518 may include shelf portions that are formed from a wire mesh which may be a woven mesh made of metal, plastic, fabric, or other suitable material. Such shelf portions may be lighter in weight than metallic shelf portions having a continuous or even corrugated structure. In another example, shelf portions may have a matrix of wires, cables, piping, tubes, or the like.

Figure 6:
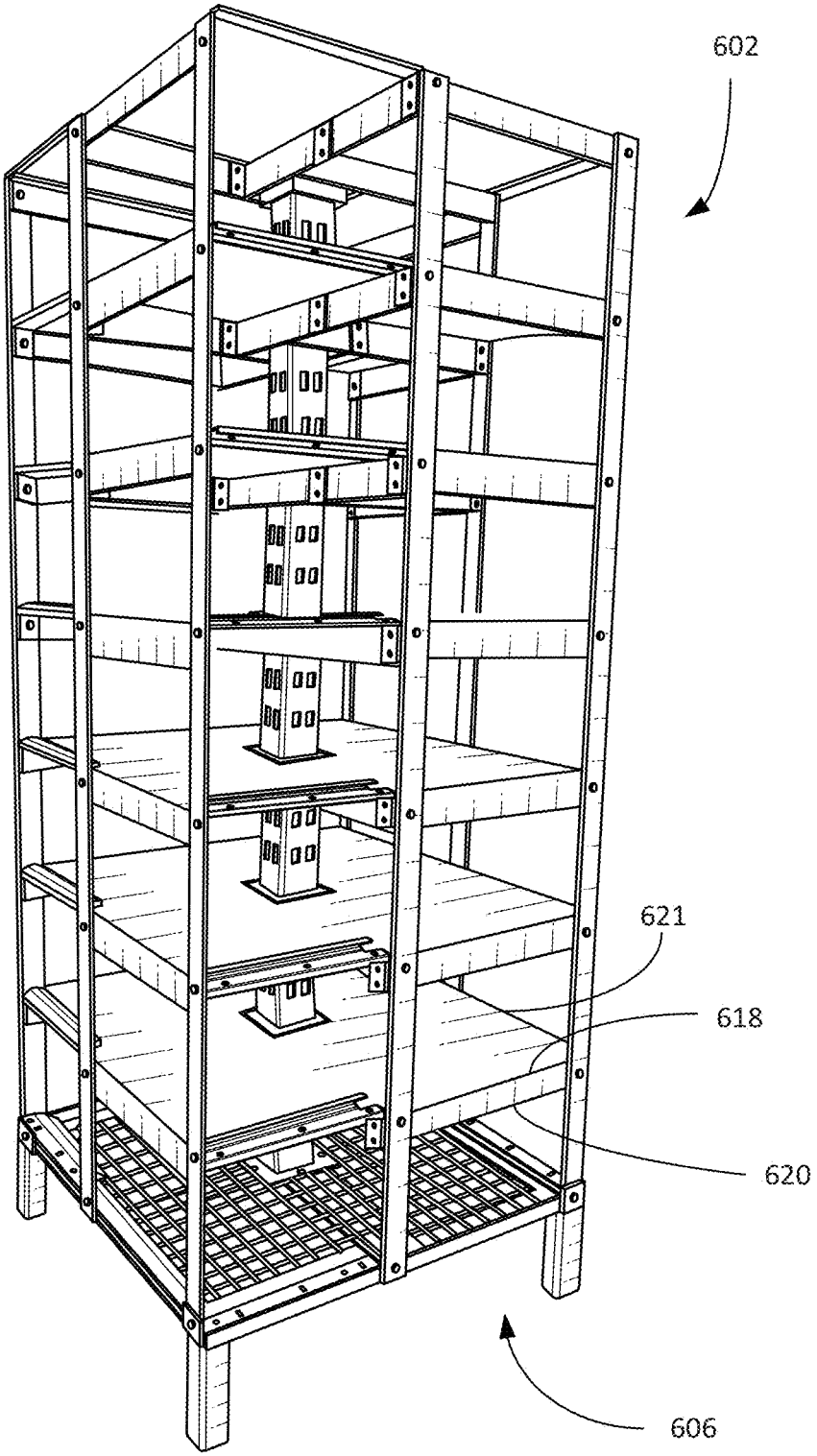
FIG. 6 is a perspective illustration of an exemplary high density support system with mesh wire shelve portions and fabric coverings, in accordance with one or more embodiments of the disclosure.

Referring now to FIG. 6, a perspective illustration of an exemplary high density support system with mesh wire shelves and fabric coverings are illustrated, in accordance with one or more embodiments of the disclosure. Container support structure 602 of FIG. 6 may be the same as or similar to container support system of FIG. 5, but with the addition of fabric coverings.

As shown in FIG. 6, container support structure 602 may include shelf assembly 618, which be formed from a wire mesh or other matrix structure. In one example, the a wire mesh structure (e.g., metallic wire mesh structure) may form shelf portions of shelf 618. Fabric cover 621 may cover a top surface of shelf assembly 618 such that the surface of shelf assembly 618 is a smooth continuous surface. For example any suitable fastener (e.g., buttons, stitching, adhesive) may be used to adhere any suitable fabric to the wire mesh structure. The fabric surface provides additional support and rigidity and also facilitate movement of the containers into and out of the container retaining areas.

Figure 7:
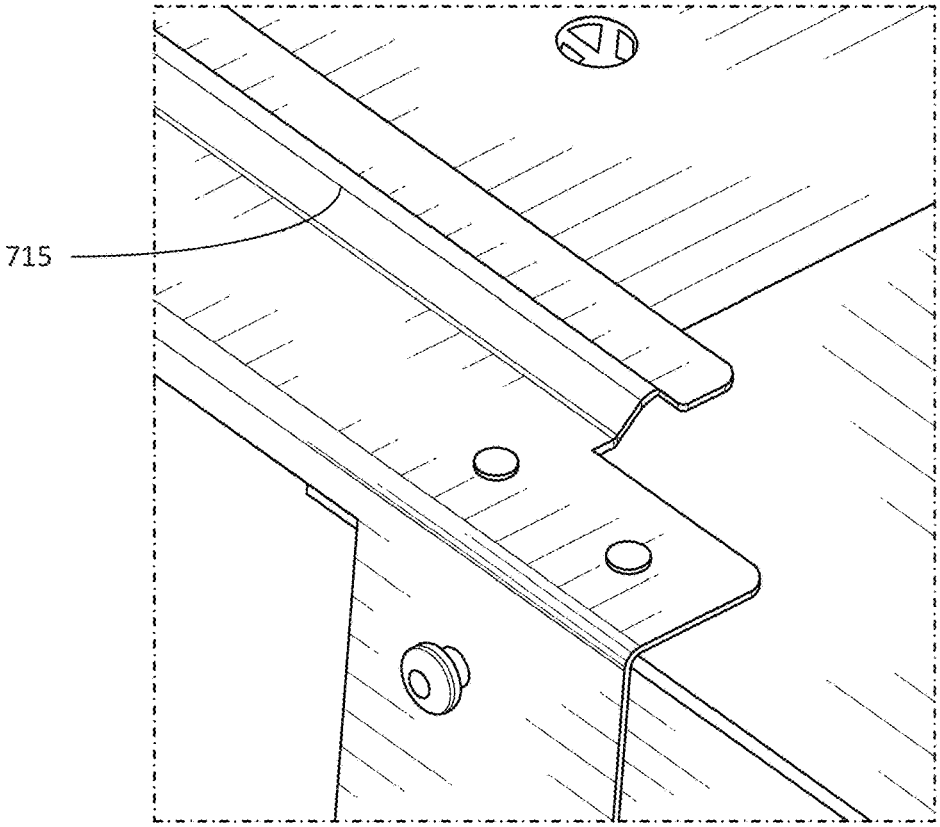
FIG. 7 is a cross-sectional view of an exemplary retention protrusion having a triangular cross-section, in accordance with one or more embodiments of the disclosure.

Referring now to FIG. 7, a cross-sectional view of an exemplary retention protrusion having a triangular cross-section is illustrated, in accordance with one or more embodiments of the disclosure. Retention protrusion 715 may be a bump extending a distance between two ends of container receiving area near an opening of the container receiving area. As shown in FIG. 7, retention protrusion 715 may have a triangular cross-section together with an upper surface of the shelf assembly. Retention protrusion 715 may be sized and shaped to more easily permit movement of a container into the container receiving area than out of the container receiving area.

Figure 8:
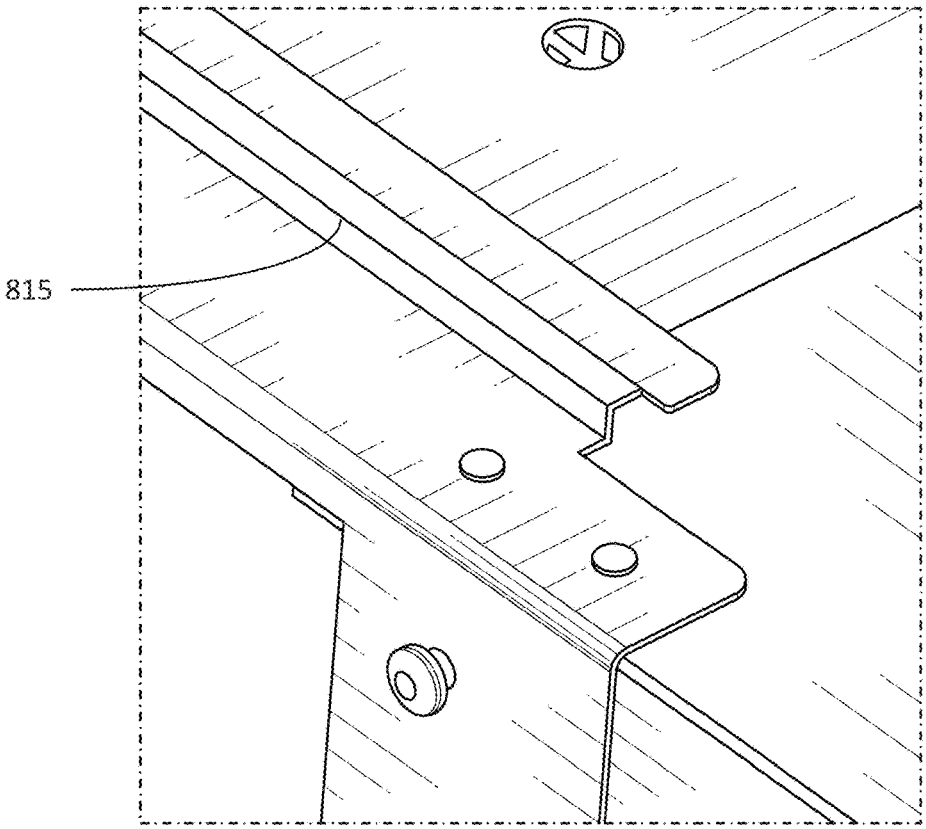
FIG. 8 is a cross-sectional view of an exemplary retention protrusion having a rectangular cross-section, in accordance with one or more embodiments of the disclosure.

Referring now to FIG. 8, a cross-sectional view of an exemplary retention protrusion having a rectangular cross-section is illustrated, in accordance with one or more embodiments of the disclosure. For example, retention protrusion 815 may be similar to retention protrusion 715 of FIG. 7 but may have a rectangular, trapezium, quadrilateral, or any similar shape together with an upper surface of the shelf assembly. It is understood that any other suitable cross-section shape that resists movement out of the container retaining area but permits the retainer to move into retainer retaining area may be used.

Figure 9:
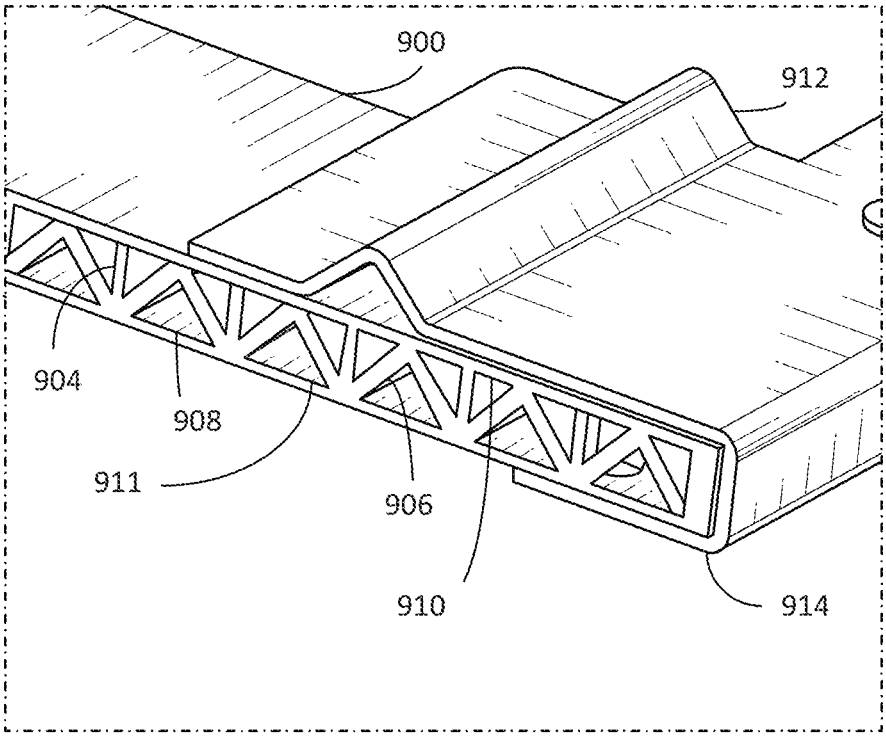
FIG. 9 is a cross-sectional view of an exemplary shelf portion structure, in accordance with one or more embodiments of the disclosure.

Referring now to FIG. 9, a cross-sectional view of an exemplary shelf portion structure is illustrated, in accordance with one or more embodiments of the disclosure. For example, shelf portion 900 may be made from a metal and/or plastic and may have an diagonal struts 906 and/or vertical struts 904 extending the length of the shelf portion between upper shelf surface 910 and lower shelf surface 911. In one example, shelf portion 900 may have an internal honeycomb structure, an internal truss structure, and/or one or more metal rods for improving rigidity. Additionally, retention protrusion 912 may be formed from clip 914 which may clip onto an end of shelf portion 900.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. A support structure system comprising:

a base comprising a platform and a set of legs, the set of legs configured to position the platform a first set distance above a surface that supports the legs, the base having a rectangular profile;

a plurality of vertical supports orientated orthogonally with respect to the platform and coupled to the base;

a center post coupled to a mid-region of the platform and oriented orthogonally with respect to the platform and parallel with respect to the plurality of vertical supports;

a first shelf assembly comprising a first shelf portion, a second shelf portion, a third shelf portion, and a fourth shelf portion, each of the first, second, third, and fourth shelf portions are arranged along a first plane, oriented in a different direction than other shelf portions from the first, second, third, or fourth shelf portions of the first shelf assembly, and offset from the other shelf portions such that a first void sized to receive and couple to the center post is formed between the first, second, third, and fourth shelf portions;

a second shelf assembly comprising a fifth shelf portion, a sixth shelf portion, a seventh shelf portion, and an eighth shelf portion, each of the fifth, sixth, seventh, and eighth shelf portions are arranged along a second plane, oriented in a different direction than other shelf portions from the fifth, sixth, seventh, or eighth shelf portions of the second shelf assembly, and offset from the other shelf portions such that a second void sized to receive and couple to the center post is formed between the fifth, sixth, seventh, and eighth shelf portions, the second shelf assembly is positioned a second set distance along the center post from the first shelf assembly; and a first set of guides coupled to the fifth shelf portion, a second set of guides coupled to the sixth shelf portion, a third set of guides coupled to the seventh shelf portion, and a fourth set of guides coupled to the eighth shelf portion;

wherein the first shelf portion, the fifth shelf portion, and the first set of guides form a first container receiving area, the second shelf portion, the sixth shelf portion, and the second set of guides form a second container receiving area, the third shelf portion, the seventh shelf portion, and the third set of guides form a third container receiving area, and the fourth shelf portion, the eighth shelf portion, and the fourth set of guides form a fourth container receiving area.

2. The support structure system of claim 1, wherein the first container receiving area has a first opening oriented in a first direction, the second container receiving area has a second opening orientated 90 degrees from the first direction, the third container receiving area has a third opening oriented 180 degrees from the first direction, and the fourth container receiving area has a fourth opening oriented 270 degrees from the first direction.

3. The support structure system of claim 1, further comprising:

a third shelf assembly comprising a ninth shelf portion, a tenth shelf portion, an eleventh shelf portion, and a twelfth shelf portion, each of the ninth, tenth, eleventh, and twelfth shelf portions are arranged along a third plane, oriented in a different direction than other shelf portions from the ninth, tenth, eleventh, or twelfth portions of the third shelf assembly, and offset from the other shelf portions such that a first void sized to receive and couple to the center post is formed between the first, second, third, and fourth shelf portions, a fifth set of guides coupled to the ninth shelf portion, a sixth set of guides coupled to the tenth shelf portion, a seventh set of guides coupled to the eleventh shelf portion, and an eighth set of guides coupled to the twelfth shelf portion; and wherein the third shelf assembly is positioned the second set distance along the center post from the second shelf assembly.

4. The support structure system of claim 3, wherein the ninth shelf portion, the fifth shelf portion, and the fifth set of guides form a fifth container receiving area, the tenth shelf portion, the sixth shelf portion, and the sixth set of guides form a sixth container receiving area, the eleventh shelf portion, the seventh shelf portion, and the seventh set of guides form a seventh container receiving area, and the twelfth shelf portion, the eighth shelf portion, and the eighth set of guides form an eighth container receiving area.

5. The support structure system of claim 1, wherein at least one of the first, second, third, and fourth shelf portions have an internal truss structure.

6. The support structure system of claim 1, wherein the base comprises a first side, a second side, a third side, and a fourth side, wherein the first side is oriented in a first direction, the second side is oriented 90 degrees from the first direction, the third side is oriented 180 degrees from the first direction, and the fourth side is oriented 270 degrees from the first direction.

7. The support structure system of claim 1, wherein each of the first, second, third, fourth, fifth, sixth, seventh, and eighth shelf portions are formed from perforated metal.

8. The support structure system of claim 1, wherein each of the first, second, third, fourth, fifth, sixth, seventh, and eighth shelf portions are formed from two or more of metal, plastic, or fabric.

9. The support structure system of claim 1, wherein the first, second, third, fourth, fifth, sixth, seventh, and eighth shelf portions are formed from wire mesh.

10. The support structure of claim 1, wherein the plurality of vertical supports are configured to support the first shelf assembly and the second shelf assembly.

11. The support structure system of claim 1, further comprising:

a first container configured to be received by the first container receiving area, a second container configured to be received by the second container receiving area, a third container configured to be received by the third container receiving area, and a fourth container configured to be received by the fourth container receiving area, wherein each of the first, second, third, and fourth containers are configured be to retrieved by an automated picker.

12. The support structure system of claim 11, wherein the first container receiving area has an opening and wherein the first shelf assembly has a retaining protrusion extending along a length of the first shelf assembly and configured to resist movement of the first container in a direction toward the opening.

13. The support structure of system of claim 12, wherein the retaining protrusion has a triangular cross-section.

14. The support structure of system of claim 12, wherein the retaining protrusion has a rectangular cross-section.

* * * * *